US005525140A

United States Patent [19]

Wisell

[11] Patent Number: 5,525,140

[45] Date of Patent: Jun. 11, 1996

[54] HIGH SPEED STEEL MANUFACTURED BY POWDER METALLURGY

[75] Inventor: Henry Wisell, Söderfors, Sweden

[73] Assignee: Erasteel Kloster Aktiebolag, Soderfors, Sweden

[21] Appl. No.: 193,033

[22] PCT Filed: Aug. 4, 1992

[86] PCT No.: PCT/SE92/00537

§ 371 Date: Feb. 4, 1994

§ 102(e) Date: Feb. 4, 1994

[87] PCT Pub. No.: WO93/02820

PCT Pub. Date: Feb. 18, 1993

[30] Foreign Application Priority Data

Aug. 7, 1991 [SE] Sweden ..... 9102300

[51] Int. Cl.[6] ..... C22C 33/02

[52] U.S. Cl. ..... 75/243; 75/246

[58] Field of Search ..... 75/246, 243; 420/10, 420/102

[56] References Cited

U.S. PATENT DOCUMENTS

| | | | |
|---|---|---|---|
| 3,809,541 | 5/1974 | Stevens | 75/236 |
| 4,116,684 | 9/1978 | Uchida et al. | 420/101 |
| 4,224,060 | 9/1980 | de Souza et al. | 420/100 |
| 4,519,839 | 5/1985 | Toyoaki et al. | 75/242 |
| 4,671,930 | 6/1987 | Kawai et al. | 420/107 |
| 4,780,139 | 10/1988 | Hellman et al. | 75/240 |
| 4,808,226 | 2/1989 | Adam | 75/246 |
| 4,936,911 | 6/1990 | Roberts et al. | 75/238 |
| 4,964,908 | 10/1990 | Greetham | 75/241 |
| 5,108,491 | 4/1992 | Matsumoto et al. | 75/242 |
| 5,252,119 | 10/1993 | Nishida et al. | 75/236 |

FOREIGN PATENT DOCUMENTS

| | | | |
|---|---|---|---|
| 0377307 | 7/1990 | European Pat. Off. | C22C 33/02 |
| 2352620 | 5/1979 | Germany | C22C 33/02 |
| 3285040 | 12/1991 | Japan . | |

*Primary Examiner*—Ngoclan Mai

*Attorney, Agent, or Firm*—Michael D. Bednarek; Marks & Murase

[57] ABSTRACT

The invention relates to a high-speed steel with good hardness and high wear resistance, which is manufactured powder-metallurgically and has the following alloy composition in weight-%: 1.0–2.5 C, max 1.0 Si, max 1.0 Mn, - 3–5 Cr, 2–8 Mo, 3–8 W, 1.3–7 V, 14–22 Co, 0–2 Nb, with the balance being substantially iron and incidental impurities and accessory elements. The steel has been designed particularly for tools, the use of which demands a good hot hardness and high wear strength.

15 Claims, 5 Drawing Sheets

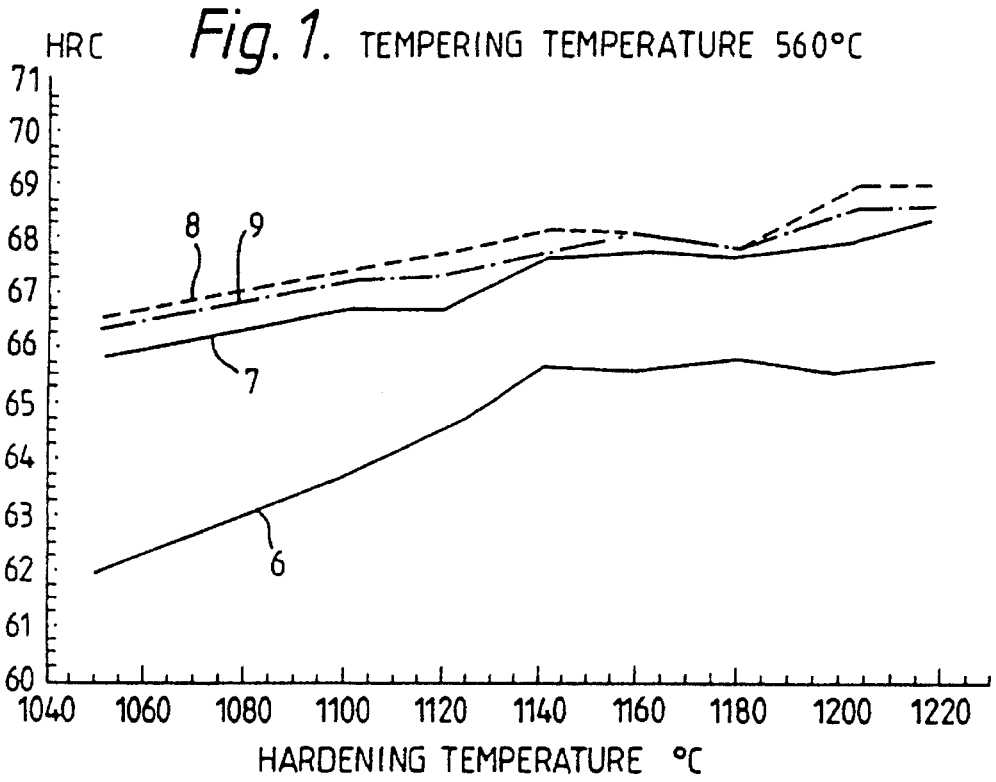
Fig. 1. TEMPERING TEMPERATURE 560°C
HRC
71
70
69
68
67
66
65
64
63
62
61
60
8
9
7
6
1040
1060
1080
1100
1120
1140
1160
1180
1200
1220
HARDENING TEMPERATURE °C
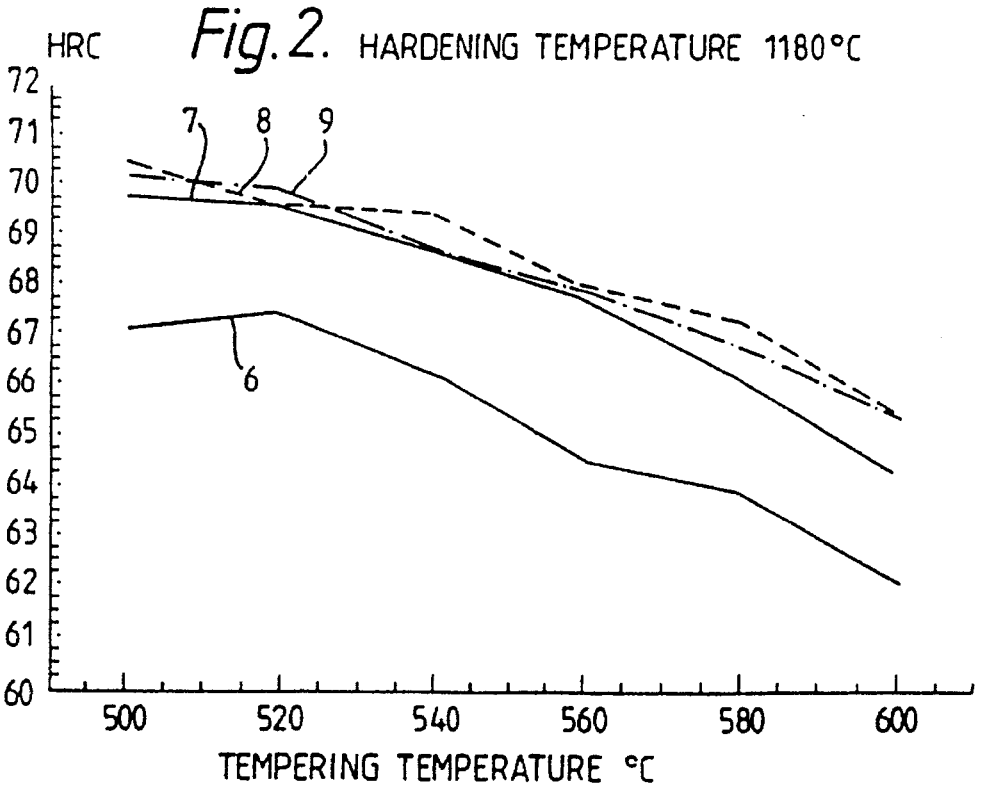
Fig. 2. HARDENING TEMPERATURE 1180°C
HRC
72
71
70
69
68
67
66
65
64
63
62
61
60
7
8
9
6
500
520
540
560
580
600
TEMPERING TEMPERATURE °C

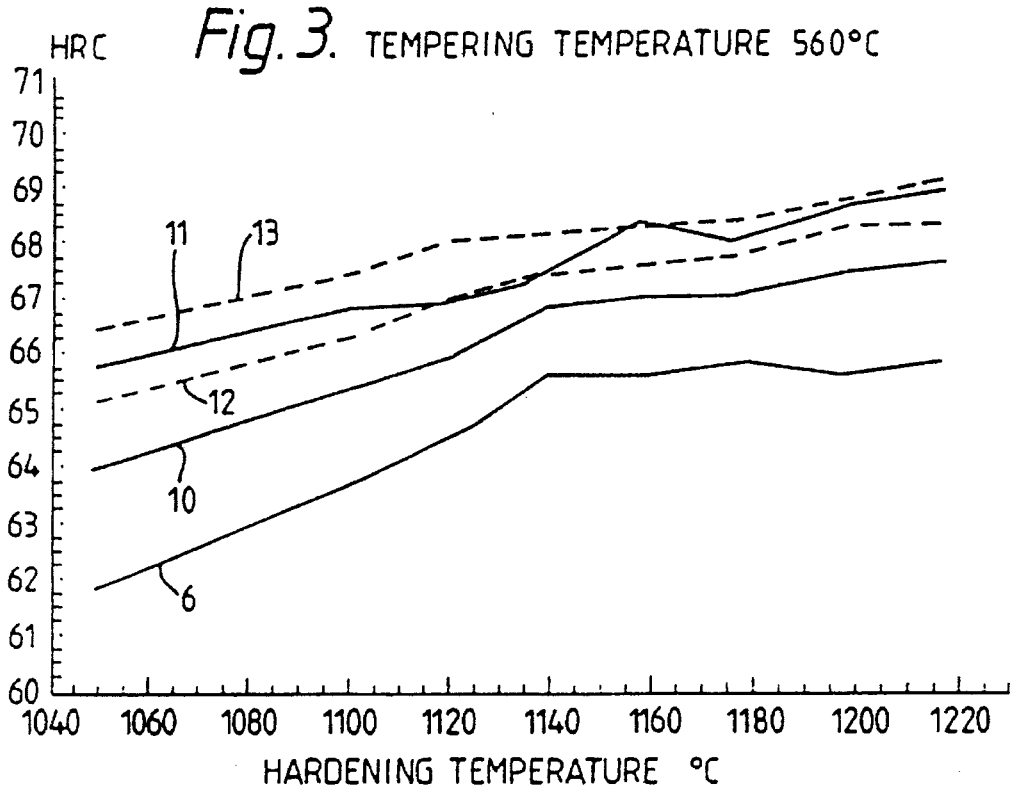
Fig. 3. TEMPERING TEMPERATURE 560°C
HRC
71
70
69
68
67
66
65
64
63
62
61
60
11
13
12
10
6
1040
1060
1080
1100
1120
1140
1160
1180
1200
1220
HARDENING TEMPERATURE °C
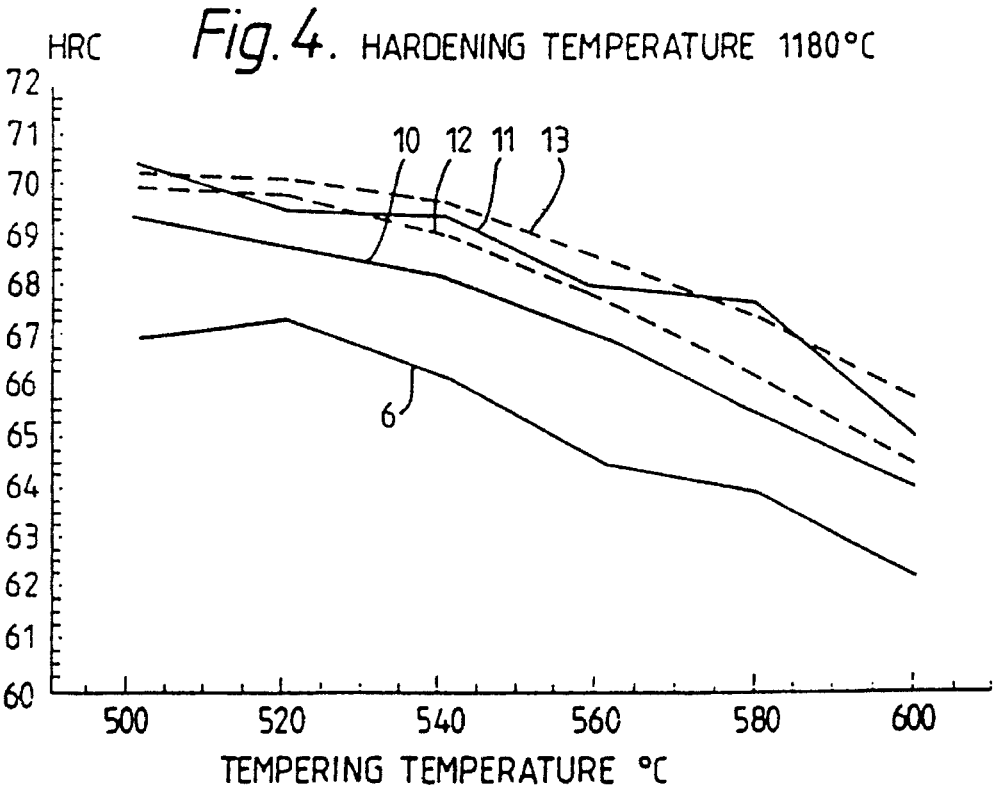
Fig. 4. HARDENING TEMPERATURE 1180°C
HRC
72
71
70
69
68
67
66
65
64
63
62
61
60
10
12
11
13
6
500
520
540
560
580
600
TEMPERING TEMPERATURE °C

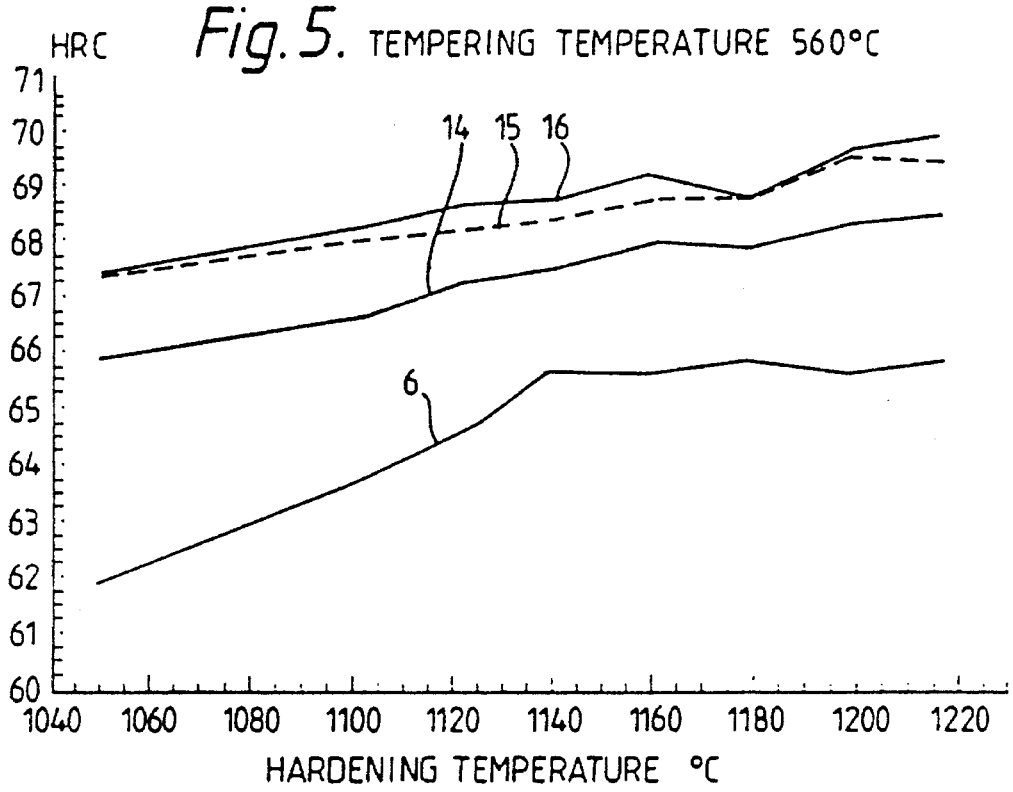
Fig. 5. TEMPERING TEMPERATURE 560°C
HRC
71
70
69
68
67
66
65
64
63
62
61
60
14
15
16
6
1040
1060
1080
1100
1120
1140
1160
1180
1200
1220
HARDENING TEMPERATURE °C
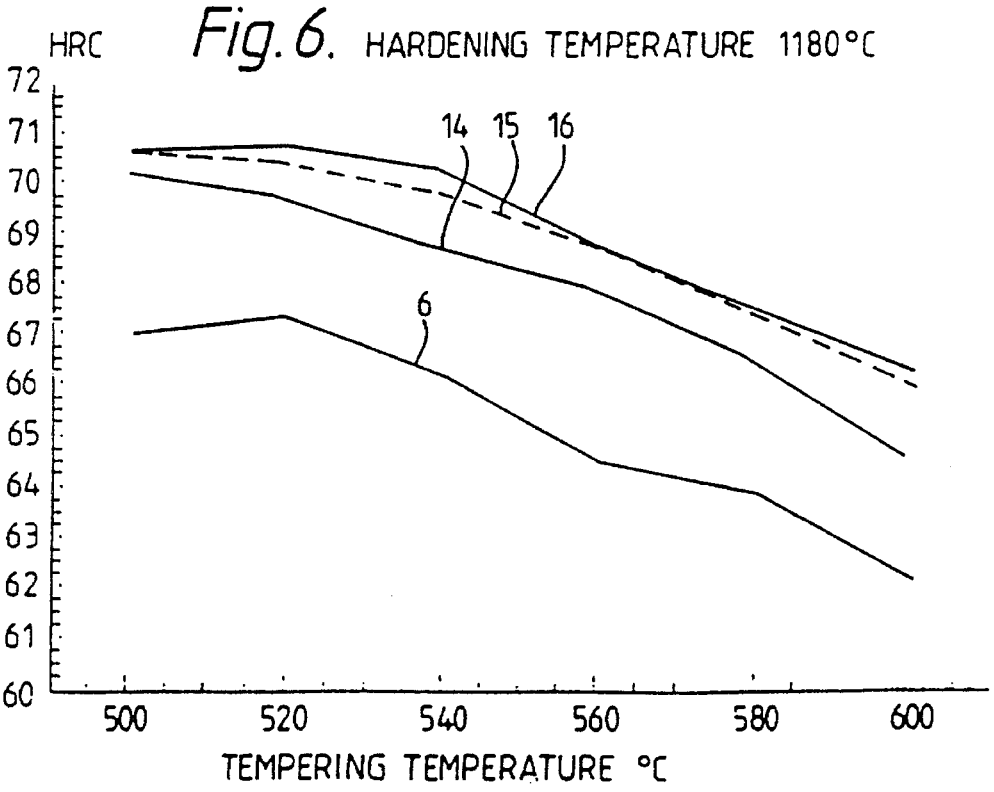
Fig. 6. HARDENING TEMPERATURE 1180°C
HRC
72
71
70
69
68
67
66
65
64
63
62
61
60
14
15
16
6
500
520
540
560
580
600
TEMPERING TEMPERATURE °C

HIGH SPEED STEEL MANUFACTURED BY POWDER METALLURGY

BACKGROUND OF THE INVENTION

The present invention relates to a new high-speed steel, which has been designed particularly for tools the use of which requires a good hot hardness and a high wear resistance. For this type of application commercial steels have previously been used, such as grade ASP®30 (currently available from Erasteel Kloster Aktiebolag, a Swedish corporation) which has the nominal composition 1.3 C, 0.4 Si, 0.3 Mn, 4.0 Cr, 5.0 Mo, 6.3 W, 8.5 Co, 3.1 V, balance iron and unavoidable impurities, or of grade ASP®60 (also available from Erasteel Kloster Aktiebolag), which has the nominal composition 2.3 C, 0.5 Si, 0.3 Mn, 4.0 Cr, 7.0 Mo, 6.5 W, 10.5 Co, 6.5 V, balance iron and unavoidable impurities. The purpose of the invention is to provide a high-speed steel having a still better hot hardness and a still higher wear resistance than the commercially available grades ASP®30 and ASP®60 as well as than other high-speed steels, known in the art, with a similar composition.

DESCRIPTION OF THE INVENTION

These and other objects according to the invention may be achieved with a steel that is manufactured powder-metallurgically, and that it has the following alloy composition in weight-%

1.0–2.5 C
max 1.0 Si
max 1.0 Mn
3–5 Cr
2–8 Mo
3–8 W
1.3–7 V
14–22 Co
0–2 Nb balance essentially only iron, unavoidable impurities and accessory elements in normal amounts.

Moreover, the coordinates for the carbon content and for the cobalt content should not lie outside the area ABDEFH in the coordinate diagram in the appending FIG. 8, preferably within the area AB'CD'E'F'GH', and suitably within the area A'B"C'D'E"F"GH" in the diagram. In the diagram, the corner points of the areas are defined by the following C/Co-coordinates:

| Broad area | Preferred area | Most suitable area |
|---|---|---|
| A 1.0/22 | A 1.0/22 | A' 1.05/21 |
| B 1.5/22 | B' 1.4/22 | B" 1.4/21 |
| D 2.5/19 | C' 1.65/19 | C' 1.65/18.5 |
| E 2.5/14 | D' 2.5/17 | D' 2.5/17 |
| F 2.0/14 | E' 2.5/15 | E" 2.5/15.5 |
| H 1.0/17 | F' 2.2/15 | F" 2.2/15.5 |
| | G 1.3/17 | G 1.3/17 |
| | H' 1.0/20 | H" 1.05/19.5 |

Within the frame which is defined by the above composition ranges and by the said diagram, respectively, there have been developed three different steel types, each one for a particular type of application. A first type—Type I—has been designed for tools which are subject particularly to a heavy adhesive wear at high temperature, where the hot hardness is of primary importance but where the wear resistance and hence the carbide volume has not the same significance as in the case of abrasive wear. Examples of typical ranges of uses for this high-speed steel of Type I are tools for cutting operations, e.g. cutter wheels, worm cutters, end-cutters, etc., particularly for working adhesive materials, such as stainless steels, titanium, and the like.

The second type—Type II—has been designed with the aim of cutting tools, such as cutter wheels, worm cutters, end-cutters, and the like, which are exposed to a combination of adhesive and abrasive wear, such as for example tools which are used for cutting case-hardening steels and other construction steels, tough-hardened steels, and the like. Typically this high-speed steel of Type II possesses in combination a very high hot hardness and a high wear resistance.

The third type of high-speed steels within the frame of the invention—Type III—has been designed in the first place for cutting as well as for non-cutting tools which are subject in the first place to abrasive wear. Cutting tools, for which this steel can be used, can be, e.g., cutter wheels, worm cutters, end-cutters, and the like for working carbon steels having high contents of cementite; certain casting steels; tool steels; etc. Among non-cutting tools, where this type of high-speed steel conveniently can be used, in the first place may be mentioned powder-pressing dies, where the steel according to the invention may replace cemented carbide as a tool material.

In the following, the choice of the various alloy elements will be explained more in detail. Herein, some theories will be explained concerning those mechanisms which may be the basis of the achieved effects. It shall, however, be emphasized that the claimed patent protection is not bound to any particular theory.

Carbon has several functions in the steel of the invention. It forms part of undissolved primary carbides as well as of precipitation hardened secondary carbides. The carbon content therefore is adapted to the contents of carbide formers in the steel. On the other hand, the carbon content must not be so high that it will cause brittleness. These conditions give the following optimal carbide content ranges for the three steel types:

Type I
1.1–1.5 C,
preferably 1.1–1.3 C,
suitably 1.15–1.25 C
Type II
1.2–2.0 C,
preferably 1.30–1.65 C,
suitably 1.30–1.45 C
Type III
2.0–2.5C,
preferably 2.2–2.5 C,
suitably 2.30–2.45 C Silicon may exist in the steel as a residue from the deoxidation of the steel melt in amounts which are normal because of normal metallurgical deoxidation practice, i.e., max 1.0%, normally max 0.7%.

Manganese may also exist in the first place as a residue from the melt-metallurgical process-technique, where manganese has importance in order to make sulphur impurities harmless, in a manner known per se, through the formation of manganese sulfides. The maximal content of manganese in the steel is 1.0%, preferably max 0.5%.

Chromium shall exist in the steel in an amount of at least 3%, preferably at least 3.5%, in order to contribute to giving the matrix of the steel a sufficient hardness. Too much chromium, however, produces retained austenite and a risk for over-tempering. The chromium content is therefore limited to max. 5%, preferably to max 4.5%.

Molybdenum and tungsten shall exist in the steel in order to cause secondary hardening through precipitation of $M_2C$-carbides during tempering after solution heat treatment and hence contribute to the desired hot hardness and wear resistance of the steel. The optimal ranges of molybdenum and tungsten for the three steel types are adapted to the other alloying elements of the steel and are chosen according to the following with the aim of causing a secondary hardening effect which is appropriate for the applications in question:

Type I
2–6 Mo,
preferably 2.5–3.5 Mo,
suitably about 3 Mo,
3–7 W,
preferably 3.5–4.5 W,
suitably about 4 W
Type II 4–8 Mo,
preferably 4.5–5.5 Mo,
suitably about 5 Mo,
4–7 W,
preferably 6–7 W,
suitably about 6.5 W
Type III
4–8 Mo,
preferably 6–8 Mo,
suitably about 7 Mo,
4–7 W,
preferably 6–7 W,
suitably about 6.5 W The matrix of high-speed steels having only a small content of vanadium and/or which does not contain niobium but which in other respects has a composition comparable to that of Type I of the invention, will be brittle when hardened from a high temperature because most of the carbides are dissolved at the solution heat treatment. However, high-speed steels having vanadium contents which are normal for conventional high-speed steels will also be brittle if the material is manufactured through conventional ingot manufacture, because in this case there will be produced large and generally unevenly distributed primary vanadium carbides, which are not dissolved at the hardening operation but will remain in their undissolved state wherein they will cause embrittlement.

These problems are solved according to the invention through two processes:

On one hand the steel is manufactured powder-metallurgically, wherein it is ensured that the primary carbides will be small and evenly distributed in the steel.

On the other hand the steel according to Type I is alloyed with niobium, preferably 1.2–1–8%, suitably about 1.5% Nb in combination with a sufficient amount of carbon to form a sufficent amount of niobium carbide, NbC, which is not dissolved to a substantial degree at the hardening temperature but will remain in its undissolved state such that it may function as a grain growth inhibitor. As an alternative to alloying the steel with niobium, the steels of Type II and Type III instead may be alloyed with so much vanadium and carbon that not all primary vanadium carbides can be dissolved during the hardening operation because of the limited ability of the steels to dissolve carbon. In spite of a high temperature at the solution heat treatment, therefore not all vanadium carbide is dissolved, but some of it will remain undissolved as small and evenly distributed carbides, which will function as grain growth inhibitors. At the same time these undissolved MC-carbides will provide the desired wear resistance against abrasive wear. However, the amount of vanadium carbide which is dissolved will again be precipitated as MC-carbides at the tempering after hardening and will herein contribute to an augumentation of the secondary hardening, and this concerns all the steels within the frame of invention. Too much vanadium, however, may cause embrittlement.

Vanadium in other words has a key role in all the steel alloys within the scope of the invention, and therefore for the specific applications vanadium optimally should exist in the following amounts:

Type I
1.3–3.5 V,
preferably 1.3–1.7 V,
suitably about 1.5 V
Type II 2.5–7 V,
preferably 2.5–3.5 V,
suitably about 3 V
Type III
4–7 V,
preferably 6–7 V,
suitably about 6.5 V Cobalt is supplied primarily in order to give the steel a high hot strength in all of its intended applications. Cobalt also has importance for the hardness by its influence upon the retained austenite therein that it readily is transformed into martensite at the tempering. One can therefore say that cobalt and carbon to some extent balance each other. For these reasons cobalt optimally should exist in the following amounts in the three intended main applications of the steel of the invention:

Type I
17–22 Co,
preferably 18–22 Co,
suitably about 20 Co
Type II
15–19 Co,
preferably 17–19 Co,
suitably about 18 Co
B Type III
15–18 Co,
preferably 15–17 Co,
suitably about 16 Co Besides the above mentioned elements the steel contains nitrogen, unavoidable impurities and other residual products in normal amounts derived from the melt-metallurgical treatment of the steel. Other elements can intentionally be supplied to the steel in minor amounts provided they do not detrimentally change the intended interactions between the alloying elements of the steel and also that they do not impair the intended features of the steel and its suitability for the intended applications.

BRIEF DESCRIPTION OF THE DRAWINGS

The high-speed steel of the invention and its features will be further explained in the following description with reference to performed experiments. Herein reference will be made to the accompanying drawings, in which FIG. 1 is a graph that shows how the hardness after hardening and tempering varies depending on the hardening temperature of some steels according to Type I within the frame of the invention and of a reference steel;

FIG. 2 is a graph that shows how the hardness varies depending on the tempering temperatures of steels of Type I within the frame of the invention and of reference steel;

FIG. 3 is a graph that shows how the hardness after hardening and tempering varies depending on the hardening temperature of some steels according to Type II within the frame of the invention and of the reference steel;

FIG. 4 is a graph that shows how the hardness varies depending on the tempering temperature of steels of Type II within the frame of the invention and of the reference steel;

FIG. 5 is a graph that shows how the hardness after hardening and tempering of some steels according to Type III within the frame of the invention and of the reference steel varies depending on the hardening temperature;

FIG. 6 is a graph that shows how the hardness of steels of Type III within the frame of the invention and of the reference steel varies depending on the tempering temperature;

The composition of the examined steels are given in Table 1. In this table there have also been included the compositions of the commerically available steels ASP®23, ASP®30 and ASP®60, all of which are currently available from Erasteel Kloster Aktiebolag, a Swedish corporation. The compositions in the table and throughout this specification refer to weight-%, with a balance comprising iron and unavoidable impurities and accessory elements in normal amounts.

TABLE 1

| Steel No. | Charge No. or steel grade | C | Si | Mn | Cr | Ni | Mo | W | Co | V | Nb |
|---|---|---|---|---|---|---|---|---|---|---|---|
| 1 | 911005 | .69 | .49 | .24 | 4.1 | .06 | 3.0 | 3.1 | .03 | 1.22 | |
| 2 | ASP ® 23* | 1.3 | .4 | .3 | 4.0 | — | 5.0 | 6.2 | — | 3.1 | |
| 3 | 911008 | .61 | .52 | .20 | 4.0 | .09 | 3.0 | 3.0 | 8.0 | 1.23 | |
| 4 | ASP ® 30* | 1.3 | .4 | .3 | 4.0 | — | 5.0 | 6.2 | 8.5 | 3.1 | |
| 5 | ASP ® 60* | 2.3 | .5 | .3 | 4.0 | — | 7.0 | 6.5 | 10.5 | 6.5 | |
| 6 | 911282 | .65 | .42 | .52 | 4.1 | | 2.5 | 2.1 | 17.1 | 1.1 | |
| 7 | 911383 | 1.14 | .50 | .30 | 3.90 | .20 | 3.02 | 4.20 | 19.2 | 1.45 | 1.47 |
| 8 | 911384 | 1.22 | .53 | .27 | 3.90 | .21 | 3.04 | 4.20 | 19.5 | 1.50 | 1.47 |
| 9 | 911385 | 1.18 | .53 | .27 | 3.90 | .19 | 3.05 | 4.20 | 19.5 | 1.47 | 1.47 |
| 10 | 911386 | 1.26 | .50 | .26 | 4.07 | .26 | 5.00 | 6.50 | 18.3 | 3.00 | |
| 11 | 911387 | 1.35 | .49 | .27 | 4.05 | .25 | 4.90 | 6.60 | 19.7 | 2.95 | |
| 12 | 911388 | 1.37 | .52 | .28 | 4.10 | .25 | 5.10 | 6.70 | 17.9 | 3.10 | |
| 13 | 911389 | 1.42 | .54 | .30 | 4.10 | .24 | 5.00 | 6.60 | 18.0 | 3.00 | |
| 14 | 911391 | 2.32 | .55 | .33 | 3.90 | .22 | 7.00 | 6.70 | 13.2 | 6.40 | |
| 15 | 911392 | 2.40 | .57 | .31 | 3.90 | .23 | 7.00 | 6.50 | 13.5 | 6.30 | |
| 16 | 911393 | 2.42 | .54 | .30 | 3.95 | .22 | 6.95 | 6.70 | 13.4 | 6.45 | |

*ASP is a registered trade mark of Kloster Speedsteel Aktiebolag.

All the steels were manufactured power-metallurgically in the form of 200 kg capsules, which were consolidated to full density through hot isostatic pressing at 1150° C., 1 h and 1000 bar.

Of the manufactured material there were made test speciments which were hardened from temperatures varying between 1050° and 1220° C., cooled to room temperature and tempered at temperatures varying between 500° and 600° C. As is shown by the curves in the graphs of FIGS. 1–6 the hardness varied depending on one hand on the hardening temperature and tempering temperature and on the other hand on the alloying level of the three main types I, II, and III of the steel of the invention.

Figure 7:
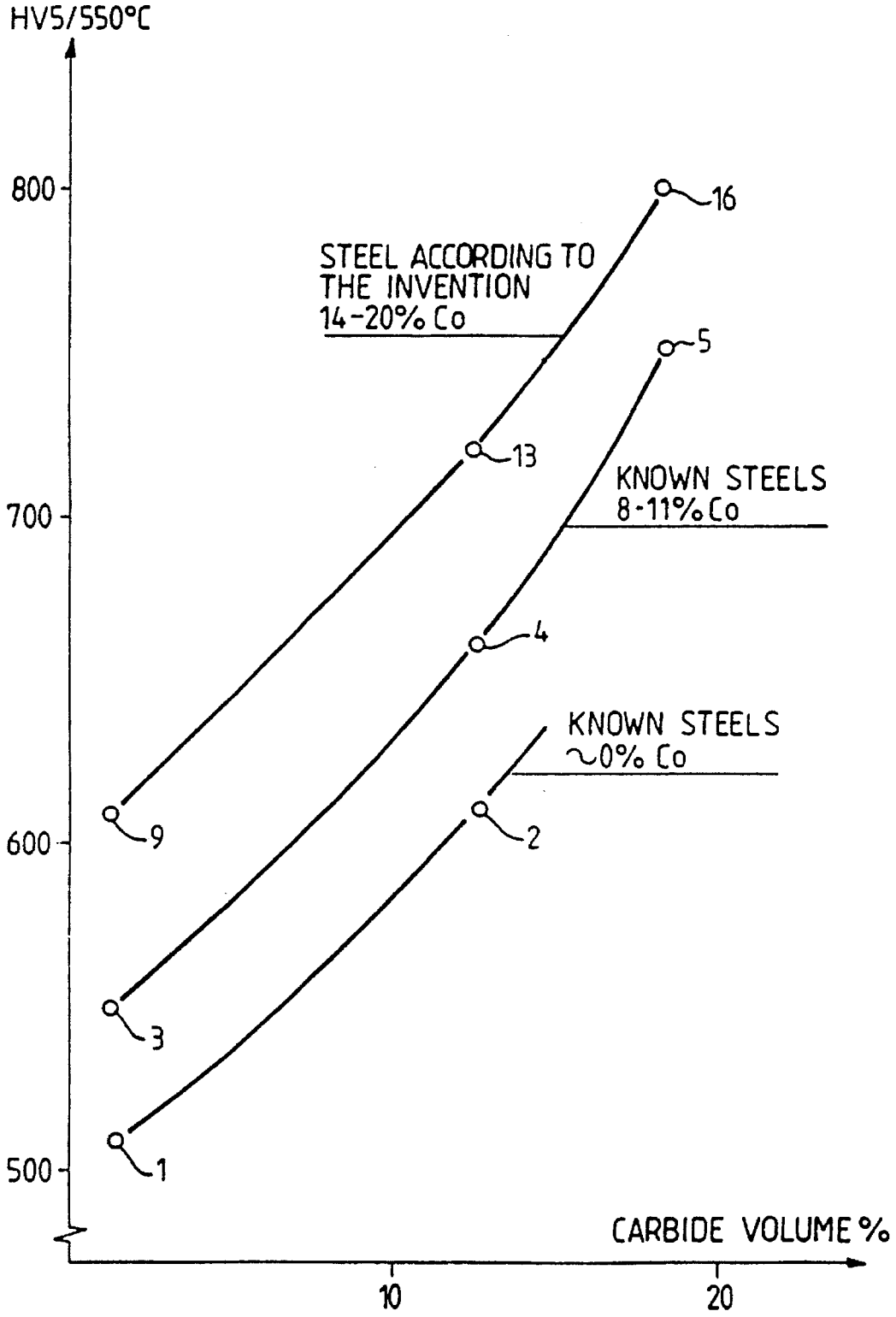
FIG. 7 is a graph that shows how the hot hardness depends on the carbide volume and on the cobalt content of the steels.

The hot hardness, which is of significant importance for the prevention of plastic deformation at those temperatures where the steel is intended to be used, is illustrated by the upper curve in FIG. 7 for steels of the invention. The middle curve shows the hot hardness for steels having a somewhat lower chromium content, while the bottom curve concerns known steels, which do not contain substantial amounts of chromium. As illustrated in the graph, the hot hardness is strongly dependent on the carbide volume, which in turn is dependent on the amount of carbon and carbide forming elements. In order to provide a high hot hardness in steels which in other respects have similar alloy levels, the high content of cobalt according to the invention is of significant importance.

I claim:

1. High-speed steel manufactured powder-metallurgically and having good hot hardness and high wear strength, comprising the following alloy composition in weight-%:

1.0–2.5 C max 1.0 Si max 1.0 Mn

3–5 Cr

2–8 Mo

3–8 W 1.3–7 V

14–22 Co

0–2 Nb with the balance being substantially iron and incidental impurities and accessory elements.

Figure 8:
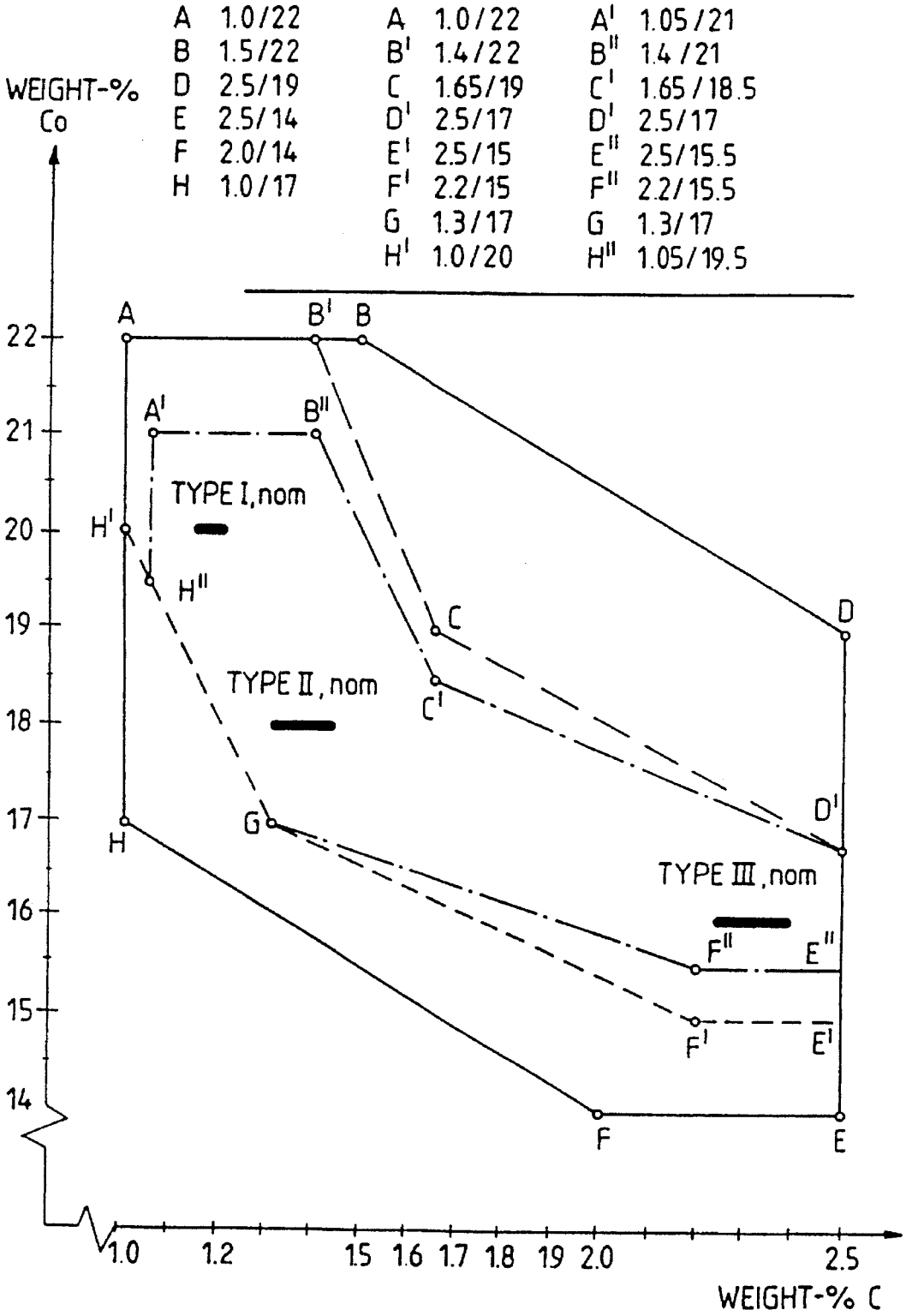
FIG. 8 is a coordinate diagram in which different areas represent the ranges for the carbon and cobalt contents.

2. High-speed steel according to claim 1, wherein said composition has coordinates for the content of carbon and cobalt that lie within the area ABDEFH in the carbon-cobalt-coordinate diagram in the accompanying FIG. 8.

3. High-speed steel according to claim 2, wherein the coordinates for the content of carbon and cobalt lie within the area AB'CD'E'F'GH' in the accompanying FIG. 8.

4. High-speed steel according to claim 3, wherein the coordinates for the content of carbon and cobalt lie within the area A'B"C'D'E"F"GH" in the accompanying FIG. 8.

5. High-speed steel according to claim 1, comprising the following alloy composition in weight-%:

1.1–1.5 C max 1.0 Si max 1.0 Mn

3–5 Cr

2–6 Mo

3–7 W
1.3–3.5 V
17–22 Co
0–2 Nb.

6. High-speed steel according to claim 1, comprising the following alloy composition in weight-%:

1.2–2.5 C
max 1.0 Si
max 1.0 Mn
3–5 Cr
4–8 Mo
4–7 W
2.5–7 V
15–19 Co with the balance being substantially iron and incidental impurities and accessory elements.

7. High-speed steel according to claim 6, comprising the following alloy composition in weight-%:

1.30–1.65 C
max 1.0 Si
max 1.0 Mn
3.5–4.5 Cr
4.5–5.5 Mo
6–7 W
2.5–3.5 V
17–19 Co.

8. High-speed steel according to claim 7, comprising the following alloy composition in weight-%:

1.30–1.45 C
0.4 Si
0.3 Mn
4 Cr
5 Mo
6.5 W
3 V
18 Co with the balance being substantially iron and incidental impurities and accessory elements.

9. High-speed steel manufactured powder-metallurgically and having good hot hardness and high wear strength, comprising the following alloy composition in weight-%:

1.1–1.3 C
3.5–4.5 Cr
2.5–3.5 Mo
3.5–4.5 W
1.3–1.7 V
18–22 Co
1.2–1.8 Nb with the balance being substantially iron and incidental impurities and accessory elements.

10. High-speed steel according to claim 6, comprising the following alloy composition in weight-%:

1.15–1.25 C
0.4 Si
0.3 Mn
4 Cr
3 Mo
4 W
1.5 V
20 Co
1.5 Nb with the balance being substantially iron and incidental impurities and accessory elements.

11. High-speed steel, comprising the following alloy composition in weight-%:

2.0–2.5 C
max 1.0 Si
max 1.0 Mn
3.5–4.5 Cr
4–8 Mo
4–7 W
4–7 V
15–18 Co with the balance being substantially iron and incidental impurities and accessory elements.

12. High-speed steel according to claim 11, comprising the following alloy composition in weight-%:

2.2–2.5 C
max 1.0 Si
max 1.0 Mn
3.5–4.5 Cr
6–8 Mo
6–7 W
6–7 V
15–17 Co.

13. High-speed steel according to claim 12, comprising the following alloy composition in weight-%:

2.30–2.45 C
0.4 Si
0.3 Mn
4 Cr
7 Mo
6.5 W
6.5 V
16 Co with the balance being substantially iron and incidental impurities and accessory elements.

14. High speed-steel according to claim 11 wherein said steel includes an amount of undissolved, evenly-distributed carbides.

15. High speed-steel according to claim 14 wherein said carbides are vanadium carbides.

* * * * *